US006065988A

United States Patent [19]

Kubota

[11] Patent Number: 6,065,988

[45] **Date of Patent: *May 23, 2000**

[54] ELECTRICAL MODULE MOUNTING STRUCTURE

[75] Inventor: Minoru Kubota, Susono, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/815,711

[22] Filed: Mar. 12, 1997

[30] Foreign Application Priority Data

Mar. 14, 1996 [JP] Japan ..... 8-057525

[51] Int. Cl.[7] ..... H01R 13/62

[52] U.S. Cl. ..... 439/329; 439/248; 439/289; 439/34

[58] Field of Search ..... 439/329, 246–248, 439/289, 34

[56] References Cited

U.S. PATENT DOCUMENTS

| | | | |
|---|---|---|---|
| 3,356,983 | 12/1967 | Johnson, Jr. | 439/329 |
| 3,613,049 | 10/1971 | Niedzwiecki | 439/329 |
| 4,602,317 | 7/1986 | Rovnyak et al. | 439/329 |
| 4,871,315 | 10/1989 | Noschese | 439/329 |
| 4,948,374 | 8/1990 | Carter | 439/329 |
| 5,049,090 | 9/1991 | Johnson | 439/329 |
| 5,263,868 | 11/1993 | Renn et al. | 439/329 |

FOREIGN PATENT DOCUMENTS

| | | |
|---|---|---|
| 58-10384 | 1/1983 | Japan . |
| 7-96774 | 4/1995 | Japan . |

*Primary Examiner*—Hien Vu
*Attorney, Agent, or Firm*—Armstrong Westerman Hattori McLeland & Naughton

[57] ABSTRACT

An electrical module mounting structure in which a connector of a wire harness on an automobile body side and a connector of an electrical module is securely and smoothly connected to each other at the mounting of modules such as an instrument panel and a meter module so that the workability of the mounting process is remarkably improved. The electrical module mounting structure for mounting an electrical module to a module accommodating portion of an instrument panel, comprises: a first positioning member formed on a rear portion of the electrical module; a face-contact terminal formed on the rear portion of the electrical module; and a second positioning member formed on a connector which is movably accommodated in the module accommodating portion of the instrument panel, wherein the electrical module is mounted to the module accommodating portion with the first and second positioning members are engaged with each other to connect the face-contact terminal of the electrical module and a terminal of the connector, which is inserted into a housing of the connector, to each other.

7 Claims, 6 Drawing Sheets

ELECTRICAL MODULE MOUNTING STRUCTURE

BACKGROUND OF THE INVENTION

1. Field of the Invention

The present invention relates to a structure for mounting an electrical module, in which switches, meters, and control circuits therefor to be mounted to an instrument panel of an automobile are integrally arranged, to an instrument panel.

Here, "an electrical module" is defined as an electrical unit in which switches, meters, control circuits therefor, flexible printed circuit boards, and the like are integrally connected and arranged.

2. Description of the Related Art

Conventionally, in electric circuits in an instrument panel of an automobile, wires of a wire harness which is formed based on prescribed electrical circuits are manually distributed to a body of the automobile and a dashboard of the instrument panel of the automobile, and connectors of the wire harness and those of the switches and the meters are connected with each other to form electric circuits.

With the advance of electronization and electrical control in an automobile, in an instrument panel mounted in front of a drive's seat, the number of switches and meters are increased and electrical circuits become complicated, therefore, the wire harness used for forming the electrical circuits becomes larger and heavier, so that it becomes difficult to accommodate such wire harness in a limited space, and a mounting work therefor is apt to be considerably complicated and inefficient.

In a Japanese Patent Publication (unexamined) No. Heisei 7-96774, a meter module M is proposed, as illustrated in FIGS. 8 and 9, to make electric circuits in an instrument panel simple.

In FIG. 9, the meter module M comprises: an instrument board a to which meters, indication lamps, and the like, and drive circuits therefor are mounted; an electric junction box b in which a power source for mounted electrical elements including the above-mentioned meters and indication lamps, and functional circuits for distributing and controlling input/output signals are accommodated; a switch unit c in which switches for the electrical elements are accommodated; a cluster module d in which the instrument board a, the electric junction box b, and the switch unit c are integrally connected with each other; and a finish panel e which is mounted on the front face of the cluster module d.

As illustrated in FIG. 8, the meter module M is to be mounted to a predetermined portion of an instrument panel f, and a connector h, which is connected to a wire harness g in the automobile, and a connector i (shown in FIG. 9), which is connected to the meter module M are connected to each other to obtain the electrical connection between the wire harness g and the meter module M.

However, in the meter module M described above, when the distance between the connector h of the wire harness g and the connector i on the meter module M side is long, the shift in relative position between the both connectors h and i becomes larger in accordance with the distance, it is required to use an expensive movable connector which is easily connected to the other connector with the larger shift in position.

Further, it may be possible to absorb the shift in position using a connector S in FIG. 10, which is disclosed in a Japanese Utility Model Publication (unexamined) No. Showa 58-10384. In the connector S, a stretchable contact m is attached to a circuit of a printed circuit board j through an elastic member k to absorb the shift in position at the contact with a mated contact n.

However, even if the expensive movable connector is used for the connector h of the wire harness g, or the connector S is adopted, work for connecting the both connectors h and i with the shift in position being absorbed is often carried out blindly, resulting in poor workability.

Further, it is difficult to apply wiring to a flat wire harness with a shape of flat board, and if a lock mechanism is adopted for a connecting mechanism like an ordinary connector, modules cannot be removed, therefore, a worker connect them with screws or the like, which may provide problems such as miswiring and frequent inferior connection.

SUMMARY OF THE INVENTION

The present invention has been made in consideration of the aforementioned problems, and the object thereof is to provide an electrical module mounting structure in which a connector of a wire harness on an automobile body side and a connector of an electrical module is securely and smoothly connected to each other at the mounting of modules such as an instrument panel and a meter module so that the workability of the mounting process is remarkably improved.

To accomplish the above-mentioned object, an electrical module mounting structure for mounting an electrical module to a module accommodating portion of an instrument panel, according to the present invention, comprises: a first positioning member formed on a rear portion of the electrical module; a face-contact terminal formed on the rear portion of the electrical module; and a second positioning member formed on a connector which is movably accommodated in the module accommodating portion of the instrument panel, wherein the electrical module is mounted to the module accommodating portion with the first and second positioning members are engaged with each other to connect the face-contact terminal of the electrical module and a terminal of the connector, which is inserted into a housing of the connector, to each other.

The mounting structure according to the present invention may further comprises: a connector accommodating cavity formed on a rear inner wall of the module accommodating portion; an elastic body disposed between the connector accommodating cavity and the housing of the connector for urging the connector housing in a direction that the connector is connected to the electrical module; and elastic tongues formed on a peripheral wall of the connector accommodating cavity for movably supporting the housing of the connector.

Further, the first positioning member can include a plurality of positioning holes formed on a rear wall of the electrical module, and the second positioning member may include a plurality of positioning pins with tapering portions standing on a front wall of the housing of the connector.

Still further, the elastic body in the mounting structure includes may be a spring.

Locking projections formed on a rear wall of the housing of the connector may be added to the above-mentioned structure according to the present invention.

A plurality of the face-contact terminals can be positioned between the positioning holes formed on the rear wall of the electrical module in the mounting structure described above.

Further, in the above mounting structure, it is possible that the electrical module has a printed circuit board at a rear portion thereof, and the face-contact terminal is formed on the printed circuit board.

Still further, the mounting structure may further comprises: cramps formed on a case of the electrical module; and engagement holes formed on a peripheral wall of the module accommodating portion, wherein the cramps are inserted into the engagement holes to fix the electrical module to the module accommodating portion.

BRIEF DESCRIPTION OF THE DRAWINGS

The present invention will be more apparent from the ensuring description with reference to the accompanying drawings wherein.

DETAILED DESCRIPTION OF PREFERRED EMBODIMENTS

Now, an embodiment of the present invention will be described below.

Figure 1:
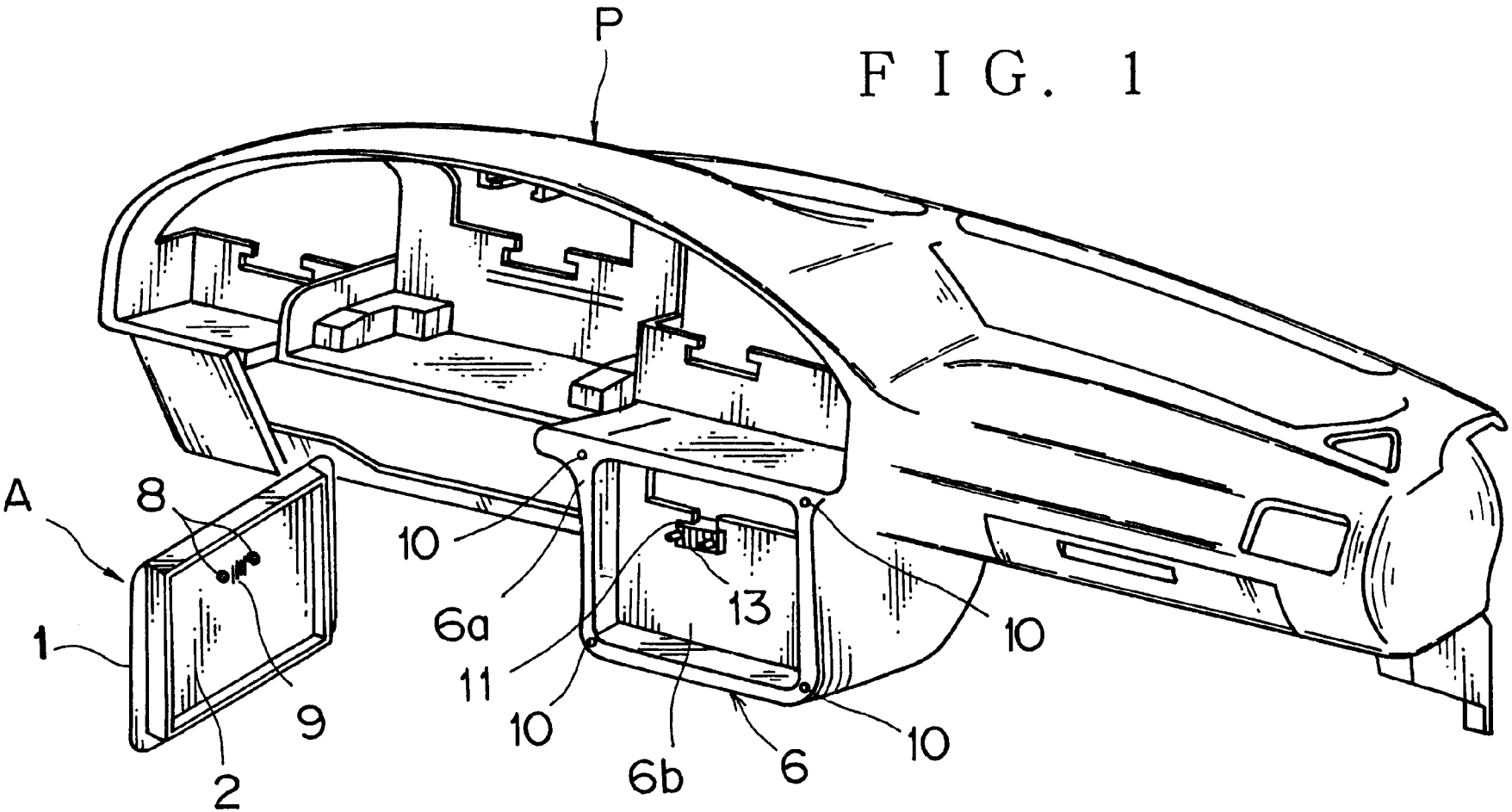
FIG. 1 is a perspective view of an electrical module and an instrument panel according to an embodiment of the present invention.

FIG. 1 is a perspective view of an electrical module A and an instrument panel P according to an embodiment of the present invention.

The electrical module A is formed as a center cluster module which is mounted at a substantially central portion of the instrument panel P, and various control circuits are accommodated in a case 1 of the electrical module A, and a printed circuit board 2 is attached to the rear portion of the case 1.

Figure 2:
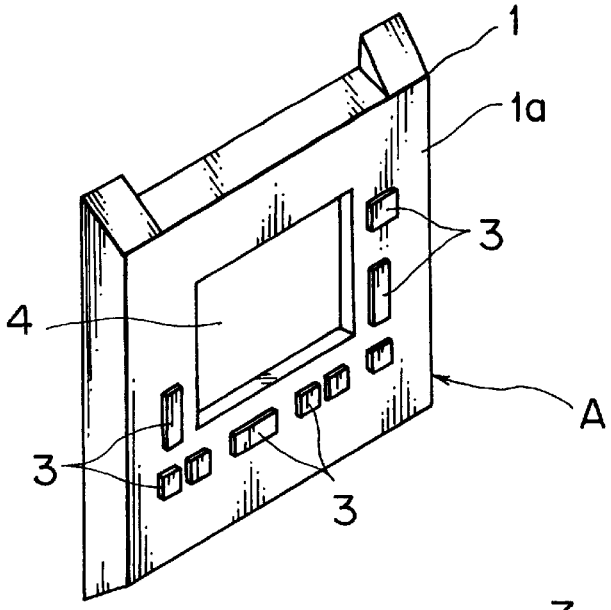
FIG. 2 is a perspective view of the front surface of the electrical module shown in FIG. 1.

As illustrated in FIG. 2, on the front wall 1*a* of the case 1 are mounted a plurality of switches 3, which are connected to the circuits in the case 1, and an displayer 4 for displaying operating conditions of instruments and various information.

Figure 3:
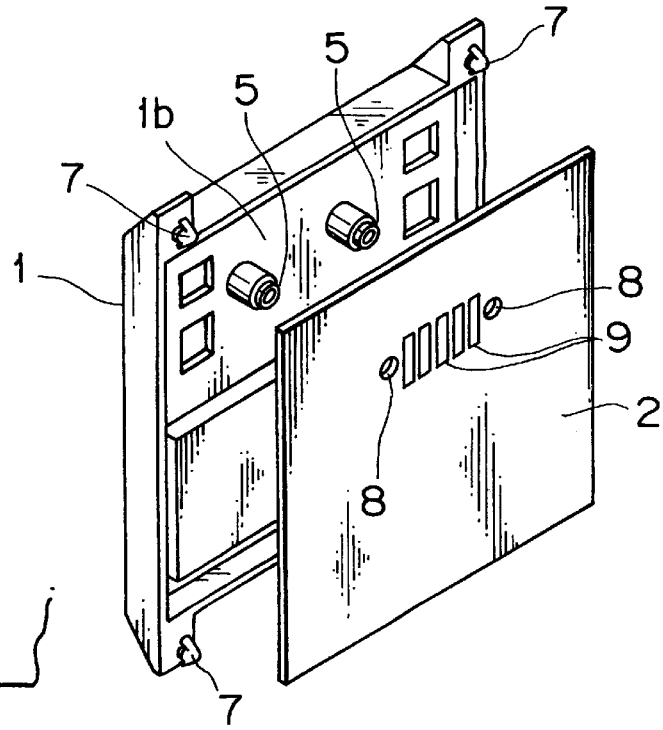
FIG. 3 is a perspective view of the rear portion of the electrical module shown in FIG. 1.
Figure 10:
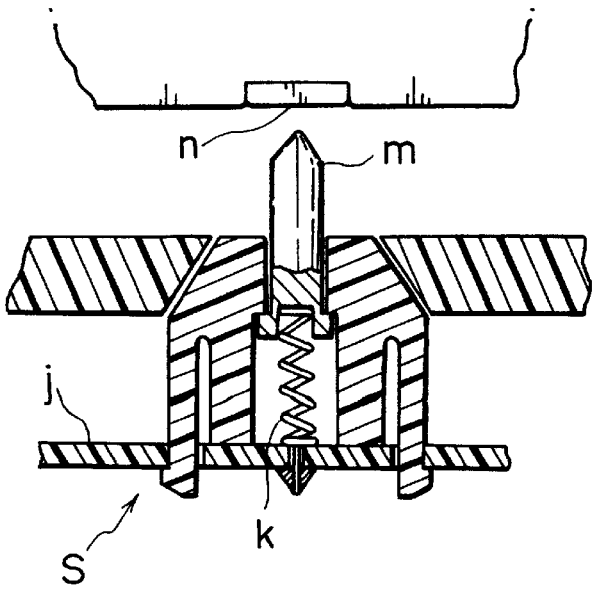
FIG. 10 PRIOR ART
FIG. 10 is a cross-sectional view of a connecting device with a conventional elastic member.

As illustrated in FIG. 3, on the rear wall 1*b* of the case 1 are formed two positioning holes 5, and on the four corners of the rear wall lb are positioned cramps to fix the electrical module A to a module accommodating portion 6 (illustrated in FIG. 6) on the instrument panel P.

Referring to FIG. 3, on the printed circuit board 2 are formed through holes 8 at positions corresponding to those of the positioning holes 5 of the case 1, and a plurality of face contact terminals 9 connected to the circuits of the printed circuit board 2 and the circuits in the case 1 are mounted in parallel with each other between the through holes 8.

Referring to FIG. 1 again, the instrument panel P is manufactured by molding synthetic resin, and the frame-shaped module accommodating portion 6 for accommodating the electrical module A is formed as a concave portion at a substantially central portion of the instrument panel P. On the four corners of a peripheral wall 6*a* of the module accommodating portion 6 are mounted engagement holes 10 to fix the electrical module A.

Figure 4:
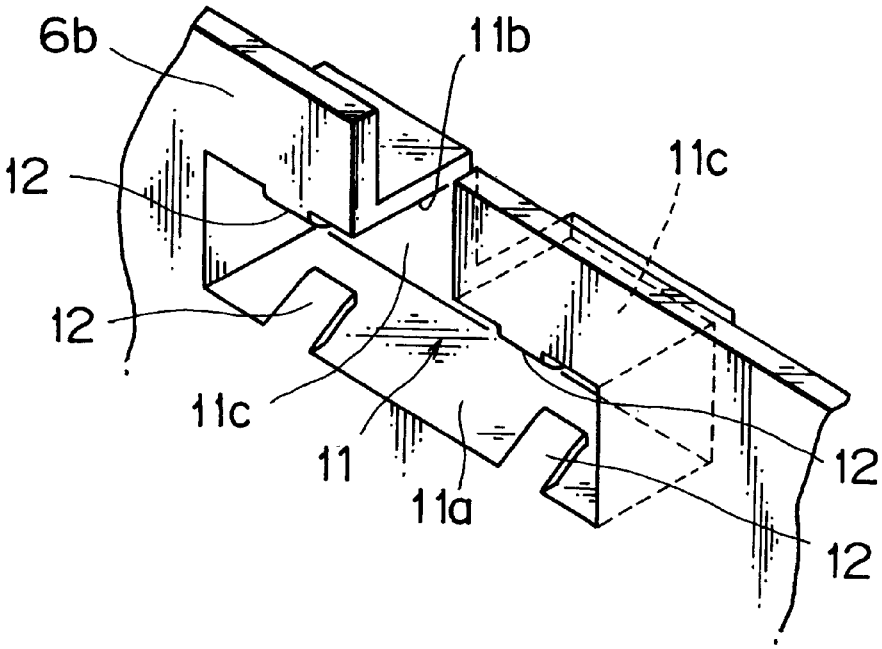
FIG. 4 is a perspective view of a connector accommodating cavity formed on the rear inner wall of a module accommodating portion shown in FIG. 1.

Referring to FIG. 4, on the rear inner wall 6*b* of the module accommodating portion 6 is formed a box-shaped connector accommodating cavity 11 with an opening thereof directing a direction that the electrical module A is connected.

Figure 5:
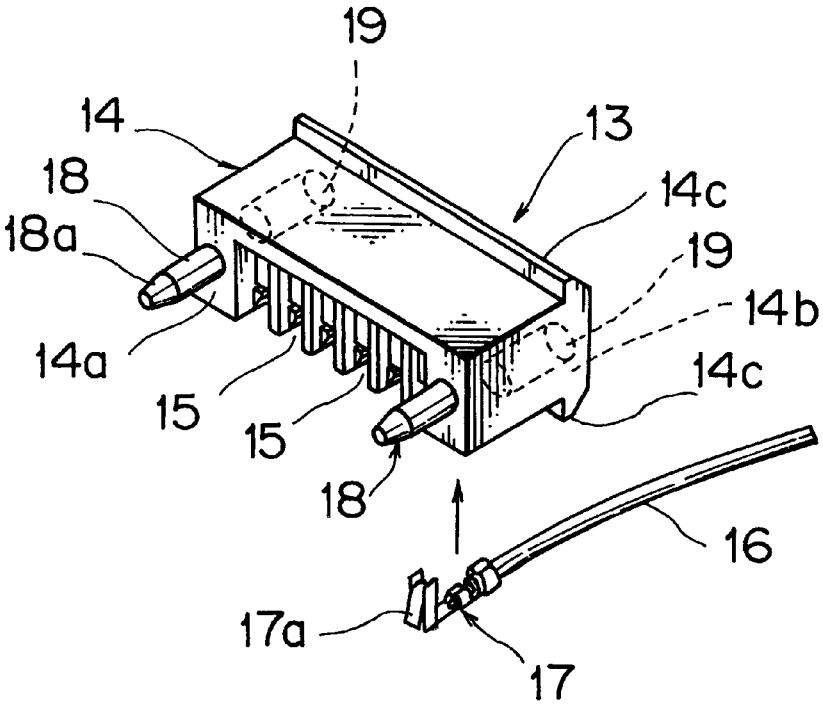
FIG. 5 is a perspective view of a connector accommodated in the connector accommodating cavity shown in FIG. 4.
Figure 6:
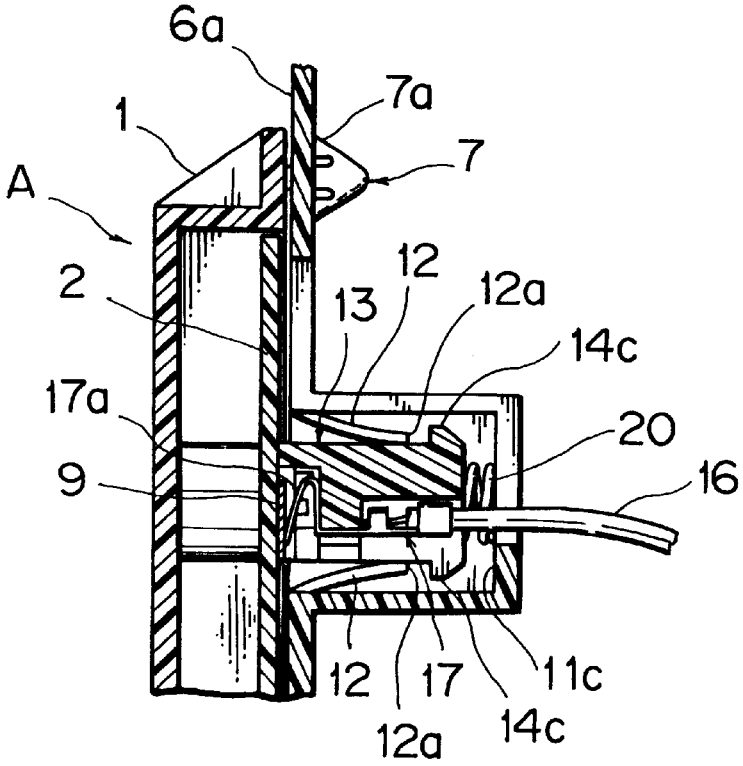
FIG. 6 is a cross-sectional view of the connector accommodated in the connector accommodating cavity which is illustrated in FIG. 4, and the electrical module connected to the connector.

On a floor 11*a* and a ceiling 11*b* of the connector accommodating cavity 11 are attached a plurality of resilient tongues 12 made of thin metal or synthetic resin with tip portions thereof being directed inward, and a connector B shown in FIG. 5 or the like is movably supported from upside and downside as illustrated in FIG. 6.

Referring to FIG. 5, the connector 13 is provided with a plurality of terminal accommodating cavities 15 in a housing 14 thereof, and in each of the terminal accommodating cavities 15 is inserted a terminal 17 at an end of a wire 16 which is diverged from a wire harness arranged in the instrument panel P and is connected to the face-contact terminal 9 on the mated electrical module A. On the right and left end portions of the front wall 14*a* of the housing 14 stand positioning pins 18 with tapering portions 18*a*.

Figure 7:
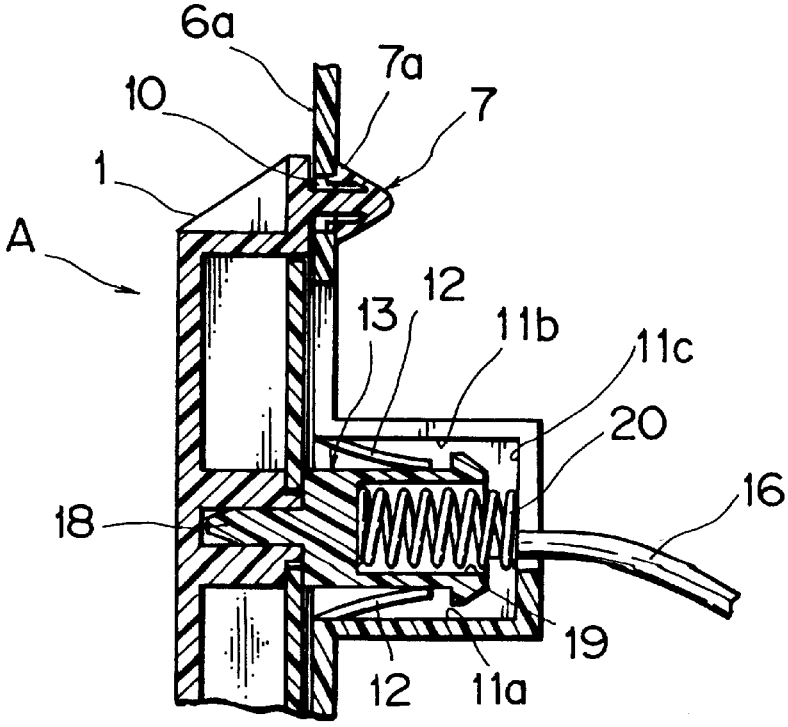
FIG. 7 is a cross-sectional view showing the state that a connector housing shown in FIG. 6 is urged through an elastic body.
Figure 8:
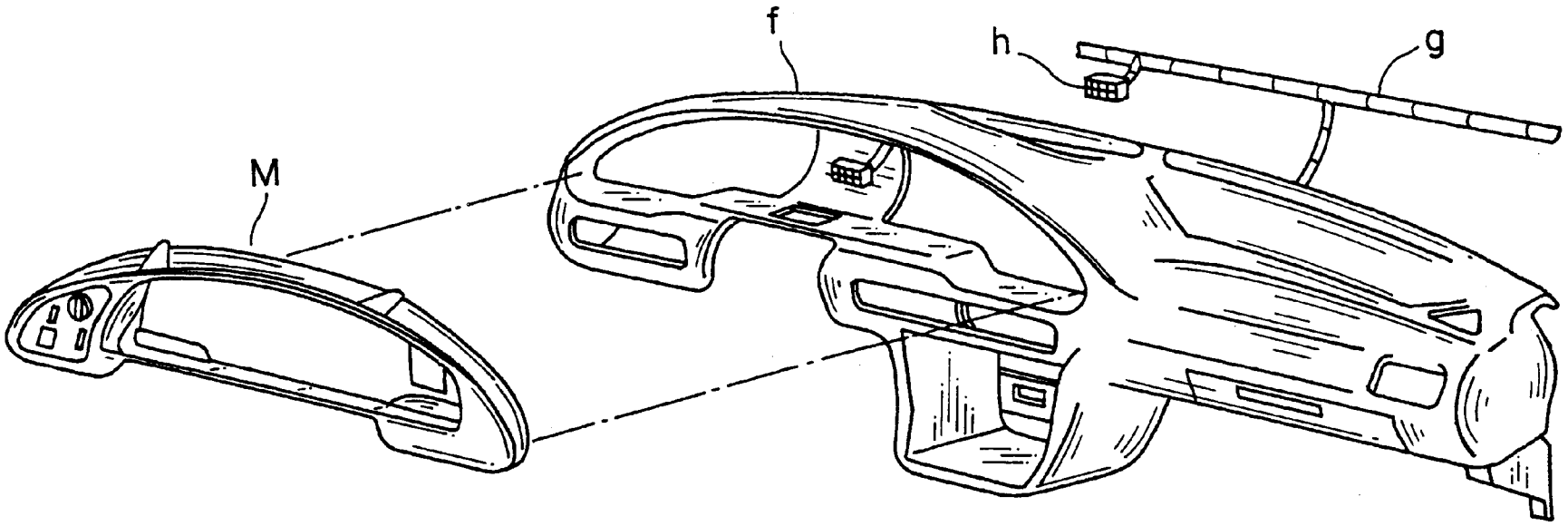
FIG. 8 PRIOR ART
FIG. 8 is a exploded perspective view of a conventional meter module.
Figure 9:
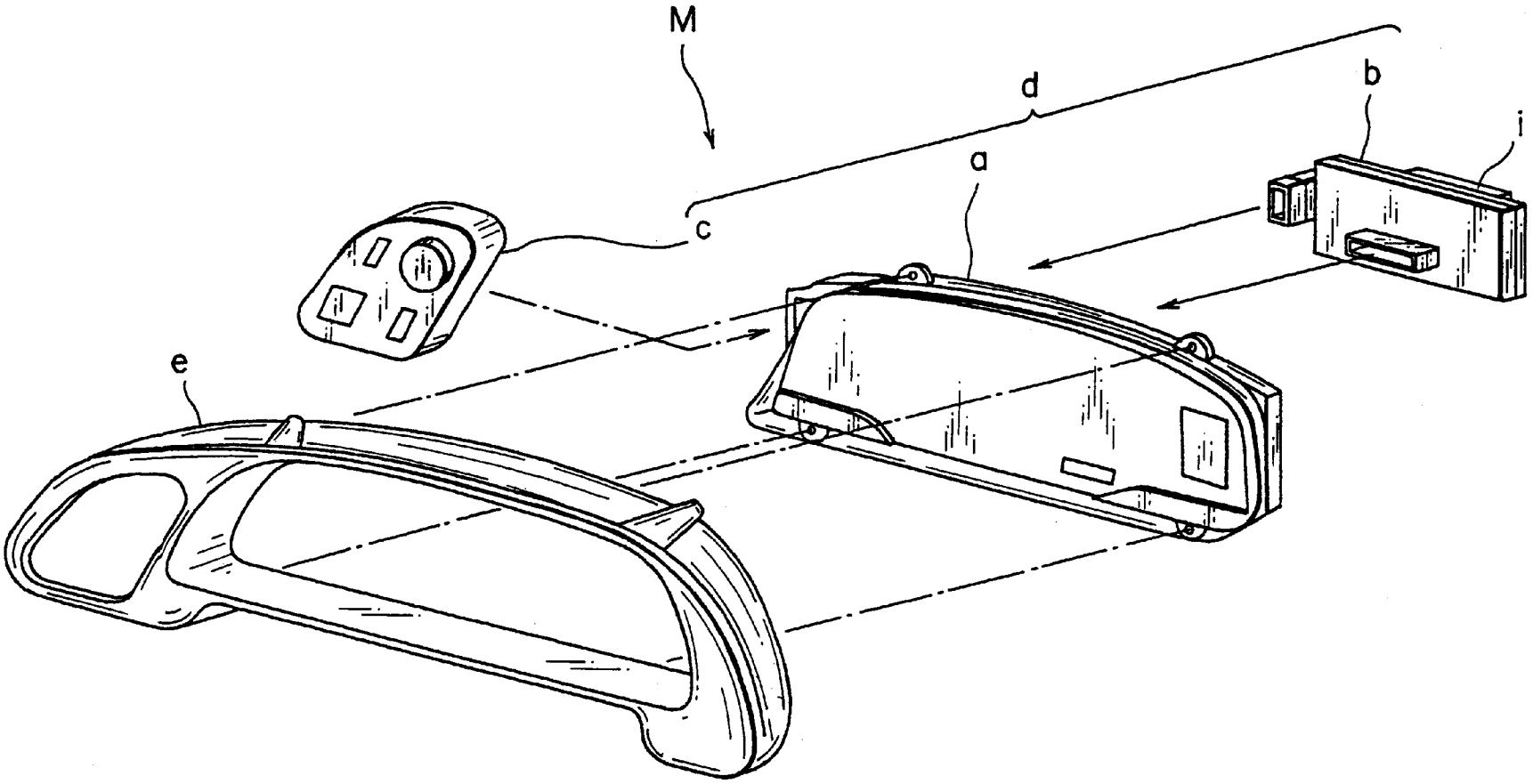
FIG. 9 PRIOR ART
FIG. 9 is a perspective view showing a process of mounting the meter module illustrated in FIG. 8 to an instrument panel.

On each of both end portions of the rear wall 14*b* of the housing 14 is drilled a supporting hole 19, and as illustrated in FIG. 7, into the supporting hole 19 is inserted a spring 20 as an elastic body, and an end of the spring 20 abuts the rear inner wall 11*c* of the connector accommodating cavity 11 to support the connector 13 while being urged to a direction that the connector 13 is connected to the electrical module A.

Referring to FIG. 5 again, at the upper and lower portions of the rear wall 14*b* of the housing 14 are formed locking projections 14*c* to prevent the housing 14 urged by the spring 20 from being slipped off through the abutment with a tip 12*a* of the resilient tongue 12 (See FIG. 6).

In order to mount the electrical module A in the module accommodating portion 6 of the instrument panel P, as illustrated in FIGS. 3 and 5, the positioning pins 18 of the connectors 13 are inserted into the positioning holes 5 of the case 1 through the through holes 8 of the printed circuit board 2 of the electrical module A. The positioning pin 18 is provided with the tapering portion 18*a* so as to securely and easily be inserted into the positioning hole 5.

Referring to FIG. 6, as the electrical module A is gradually pushed into the connector 13, the electrical contact 17*a* of the terminal 17 in the terminal accommodating cavity 15 of the connector 13 and the face-contact terminal 9 of the printed circuit board 2 contact with each other. When the electrical module A is further pushed, the front wall 14*a* (See FIGS. 5 and 6) of the housing 14 abuts the printed circuit board 2 to prevent the electrical contact 17*a* of the terminal 17 from deflecting excessively.

Referring to FIG. 7, as the electrical module A is continuously pushed, the spring 20 is pressed, which strengthens the press of the housing 14 against the printed circuit board 2. Consequently, each of the cramps 7 of the electrical module A is inserted into the engagement hole 10 of the module accommodating portion 6. The moment that the cramps 7 are completely inserted into the engagement holes 10, the locking arms 7*a* at the tip of the cramps 7 open, and the electrical module A is fixed to the peripheral wall 6*a* of the module accommodating portion 6.

The connector 13 is urged by the spring 20, so that the electrical contact 17*a* of the terminal 17 flexibly contacts the face-contact terminal 9 on the printed circuit board 2 of the electrical module A, resulting in secure electrical connection.

The connector 13 is movably supported by the resilient tongue 12, therefore, even if a slight shift in position is generated between the electrical module A and the connector 13, the position of the connector 13 is automatically adjusted to secure proper relative position between the face-contact terminal 9 of the electrical module A and the terminal 17 in the connector 13.

The electrical module A described above is referred to as a center cluster module, however, the present invention may be applied not only to the center cluster module but also other modules such as a meter module and a cluster module.

In the present invention, a connector, which is to be connected to an electrical module, is movably accommodated in a module accommodating portion of an instrument panel to which the electrical module is mounted, so that positioning of the connector against the electrical module is securely and easily carried out, which improves the workability of mounting work and the positioning may be carried out in automatic mounting process.

Further, the connector is always urged to the electrical module through an elastic body, therefore, face-contact terminals of the electrical module and connected terminals of the connector are securely connected with each other, providing many advantages such as improved electrical reliability.

What is claimed is:

1. An electrical module mounting structure for mounting an electrical module to a module accommodating portion of an instrument panel, said electrical module mounting structure comprising:

a printed circuit board formed on a rear portion of said electric module;

a face contact terminal formed on said rear portion of said printed circuit board, said rear portion of said electrical module having therein a positioning hole;

a positioning pin formed on a connector which is movably accommodated in a cavity of said module accommodating portion of said instrument panel, the connector having a housing including a terminal, and elastic tongues formed from an inner wall of said module accommodating portion to a peripheral wall of a housing of the connector and extending along an accommodating cavity therebetween for movably supporting the housing of the connector from slipping off, wherein the electrical module is mounted to the module accommodating portion with said positioning hole and positioning pin being engaged with each other to connect the printed circuit board of the electrical module and the terminal of the connector to each other, the terminal of the connector being inserted into the housing of the connector.

2. The electrical module mounting structure as claimed in claim 1 further comprising:

said connector accommodating cavity formed on a rear inner wall of said module accommodating portion; and an elastic member disposed between said connector accommodating cavity and said housing of the connector for urging the connector housing in a direction that the connector is connected to the electrical module.

3. The electrical module mounting structure as claimed in claim 2, wherein said printed circuit board includes a plurality of positioning holes formed on a rear wall of said electrical module, and a plurality of positioning pins with tapering portions standing on a front wall of the housing of the connector.

4. The electrical module mounting structure as claimed in claim 2, wherein said elastic member includes a spring.

5. The electrical module mounting structure as claimed in claim 2, further comprising locking projections formed on a rear wall of said housing of the connector.

6. The electrical module mounting structure as claimed in claim 2, wherein a plurality of said face-contact terminals are positioned between said positioning holes formed on the rear wall of the electrical module.

7. The electrical module mounting structure as claimed in claim 1 further comprising:

cramps formed on a case of said electrical module; and engagement holes formed on a peripheral wall of said module accommodating portion, wherein said cramps are inserted into said engagement holes to fix the electrical module to the module accommodating portion.

* * * * *